US011959199B2

(12) United States Patent
Tracy et al.

(10) Patent No.: US 11,959,199 B2
(45) Date of Patent: Apr. 16, 2024

(54) SUPPORTED SPINDLE HOLDING DEVICE

(71) Applicants: Daniel Edward Tracy, Cortland, NY (US); Lorraine G. Tracy, Cortland, NY (US)

(72) Inventors: Daniel Edward Tracy, Cortland, NY (US); Lorraine G. Tracy, Cortland, NY (US)

( * ) Notice: Subject to any disclaimer, the term of this patent is extended or adjusted under 35 U.S.C. 154(b) by 0 days.

(21) Appl. No.: 17/803,719

(22) Filed: Oct. 31, 2022

(65) Prior Publication Data

US 2024/0076809 A1 Mar. 7, 2024

Related U.S. Application Data

(63) Continuation of application No. 17/000,320, filed on Aug. 23, 2020, now Pat. No. 11,519,105.

(60) Provisional application No. 62/894,219, filed on Aug. 30, 2019.

(51) Int. Cl.
*D01H 17/00* (2006.01)

(52) U.S. Cl.
CPC ..... *D01H 17/00* (2013.01)

(58) Field of Classification Search
CPC ..... D01H 7/00; D01H 17/00
See application file for complete search history.

(56) References Cited

U.S. PATENT DOCUMENTS 1,445,867 A * 2/1923 Binder ..... A47J 43/046 99/626
2,168,969 A * 8/1939 Bickerstaff ..... F25D 3/08 D7/584

OTHER PUBLICATIONS www.aaronknits.com/2018/11/04/the-story-of-the-supported-spinning-yoke/.

* cited by examiner

*Primary Examiner* — Patrick J. Lynch

(57) ABSTRACT

A supported spindle holding device is described herein for holding a supported spindle while spinning fiber into yarn or thread. The device having an elongated body and a bowl disposed on the body for retaining the spinning tip of the supported spindle.

2 Claims, 8 Drawing Sheets

SUPPORTED SPINDLE HOLDING DEVICE

CROSS REFERENCE RELATED APPLICATIONS

This application is anon-provisional application claiming the benefit of priority to U.S. patent application Ser. No. 17/000,320, filed Aug. 23, 2020, which claims priority to U.S. Patent Application No. 62/894,219, filed on Aug. 30, 2019. The complete disclosure of the aforementioned related patent applications are hereby incorporated by reference of all purposes.

BACKGROUND

The present invention pertains to the field of textiles, spinning, twisting and twining of fiber into yarn or thread. The art of hand spinning fiber typically uses one of two types of spindles: a drop spindle and a support spindle. While both types of spindles spin the fiber into yarn or thread by rotating the spindle, they do so in different ways. The individual using the drop spindle, uses their fingers to begin the rotation of the twisting of the fiber by flicking his fingers around the shaft of the drop spindle. While the drop spindle is rotating, fiber is held between the spinners fingers. The fiber is slowly released from the hand and fingers as the drop spindle is freely allowed to spin using gravity to bring the spindle towards the floor. It is only the fiber being released from the hand and fingers that is connected to the spindle that is spinning the raw fiber into yarn or thread. The inclusion of a support bowl permits the spinner to spin with ease both short and long fibers into yarn. A support spindle or the supported spindle relies on a means for support, like a support cup or bowl, during spinning of the fiber to yarn, which can be accomplished by resting the spinning tip of the supported spindle onto something flat, and hard, for example, on the ground, on a table or in the round bottom of a small bowl.

There are problems with the aforementioned means for support of a support spindle. For example, the supported spindle can freely move in any direction during rotation on The lip of the present invention may have uses other than retaining the spinning tip of the supported spindle. The lip may hold a separate spinning bowl in place when such separate spinning bowl is set inside the bowl opening with the separate spinning bowl behind secured in place by the lip or the separate spinning bowl rests on the inner facing wall of the receiving bowl.

While the foregoing specification teaches the principles of the present invention, with examples provided for the purpose of illustration, it will be understood that the proactive of the invention encompasses all of the usual variations, adaptations, and/or modifications as come within the scope of the following claims and their equivalents flat, hard surfaces, the ground or the table because there is no containment of the spinning tip during the spindle's rotation. A bowl is often used as a containment device but this also suffers from its own set of issues. The bowl can still move on the flat surface of a table, chair or ground. Often spinners will have the bowl pressed between the thighs of the user's legs. This problem has been addressed by including a shaft extending from the support cup or bowl that is inserted between the spinner's thighs and held in place by the spinner squeezing their thighs together while in a seated position. However, the bowl can still move out of place during spinning whether by tipping over or physically moving forward or backward. This method also causes strain to the leg muscles of the spinner.

The present invention overcomes these problems by using a immobile or fixed support to maintain the movement of the supported spindle during spinning and additionally eliminates the need of requiring spinner leg strength to hold a shaft of a support bowl level while spinning. The supported spindle holding device of the present invention improves portability, individual adjustments, and comfort while in use, i.e., while spinning the support spindle. The supported spindle holding device of the present invention includes at least one integrated receiving bowl that is disposed on a top side of the support spindle holding device for the spinning tip to rest in during the flicking, spinning or rotation of the fiber into yarn or thread. By using an integrated bowl in the supported spindle holding device, the spinner will be able to spin yarn or thread much more comfortably and faster than previous methods of supporting the supported spindle. In addition, the present invention will allow spinners using a supported spindle holding device more freedom and comfort, including people with physical disabilities. The supported spindle holding device of the present invention can rest on the spinner's thighs and, because the bowl is integrated into the device, there are no movable objects for the spinner to worry about keeping in place during flicking, spinning, or rotation of the fiber into yarn or thread. The length of supported spindle holding device of the present invention allows the spinner to sit in a more natural seated position because the width allows the seated spinner to choose to place the supported spindle holding device either close to their body or father away from their core region, all the way out to their knees, without forcing their legs inward from their hips at an uncomfortable angle.

SUMMARY

The present invention is directed to a supported spindle holding device comprising, consisting of, and/or consisting essentially of a body having an upper surface having a length and a width and a bottom surface having a length and a width, and a receiving bowl integrated in the upper surface of the body for receiving a spinning tip of the support spindle, the receiving bowl having a bowl opening, a bowl bottom opposite the bowl opening, and a bowl wall that spans from the bowl opening to the bowl bottom to form a concave interior portion of the bowl.

In one embodiment, the present invention is directed to a supported spindle holding device comprising, consisting of, and/or consisting essentially of a body having an upper surface having a length and a width and bottom surface having a length and a width, and a receiving bowl releasably attached to the upper surface of the support spindle holding device, wherein the receiving bowl includes a bowl opening, a bowl bottom opposite the bowl opening, and a bowl wall that spans from the bowl opening to the bowl bottom to form a concave interior portion of the bowl, wherein the wall includes a lip.

In one embodiment, the present invention is directed to a supported spindle holding device comprising, consisting of, and/or consisting essentially of an elongated body having an upper surface having a length and a width, a bottom surface having a length and a width, and a center portion having two opposite elongated wing portions, a left elongated wing portion and a right elongated wing portion, each of which may be optionally releasably attached to the center portion, each elongated wing portion is symmetrical and concave in shape, for resting the bottom surface of the supported spindle holding device on both thighs of a spinner, and a receiving bowl integrated in the upper surface of the center portion of the body, the receiving bowl including a bowl opening, a bowl bottom opposite the bowl opening, and a bowl wall that spans from the bowl opening to the bowl bottom to form a concave interior portion of the bowl, wherein the bowl wall includes an integral lip.

DETAILED DESCRIPTION

As used herein, the terms "support spindle" and "supported spindle" mean the same device.

As used herein, the terms "yoke" and "leg supported device" are used interchangeably and each mean a supported spindle holding device.

Figure 1:
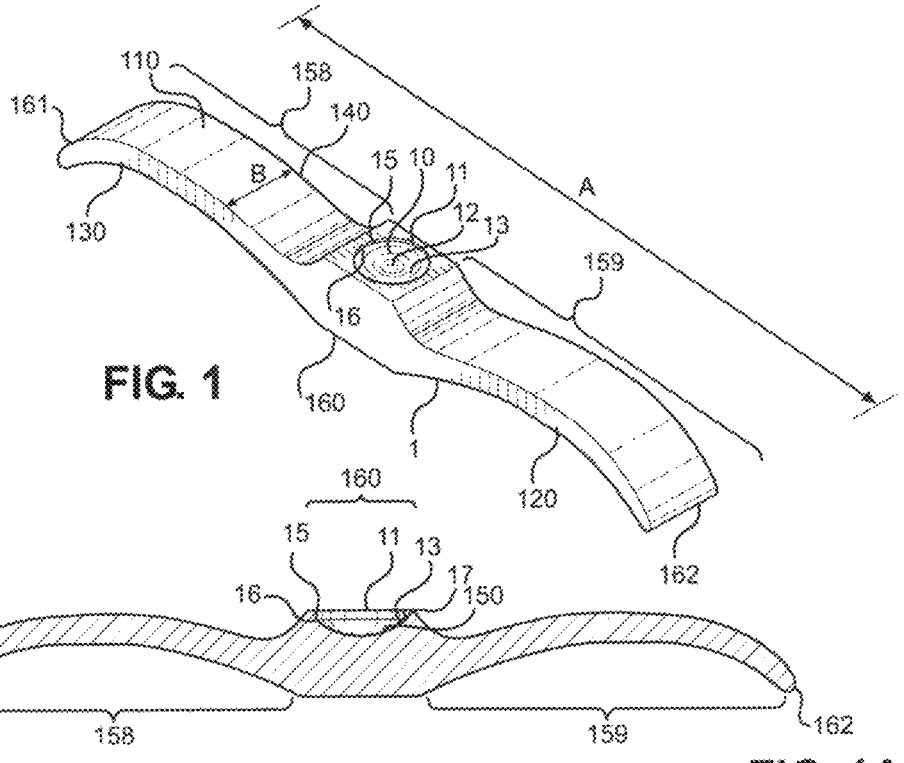
FIG. 1 depicts a view of a supported spindle holding device of the present invention.

FIG. 1 depicts a supported spindle holding device that has an elongated body that is a supported spindle holding device 1 of the present invention having a top side 110 opposite a bottom side 120, a body facing side 130 connecting the top side 110 to the bottom side 120, and an away facing side 140 connecting the top side 110 to the bottom side 120. The top side 110 and bottom side 120 each having a length A and width 13 wherein the length is substantially long enough to cover both spinner's thighs while the spinner is seated and the width being between about 0.5 inch and 8 inches, preferably between about 1 inch and 6 inches, even more preferably between about 2 inches and 5 inches and most preferably between about 3 inches and 4 inches. Disposed on top side 110 substantially in the middle of length A and width B is receiving bowl 10.

Receiving bowl 10 is an integrated bowl or cup that is the concave portion of supported spindle holding device 1, which includes a bowl opening 11, a bowl bottom 12, and a bowl wall 13 that spans the bowl opening 11 to the bowl bottom 12 and forms the concave interior portion of the bowl, which is the bowl interior. Optionally, receiving bowl 10 may be removable from supported spindle holding device 1 by using a means for removably attaching receiving bowl 10 to the supported spindle holding device 1, which is not depicted. Means for removably attaching receiving bowl 10 to the supported spindle holding device 1 include hook and loop fastening tape, adhesive tape, screws, nails, keel on the receiving bowl 10 and a slot in supported spindle holding device 1, and the like. Also, when a removable receiving bowl is used, it may include means for adjusting the height of the receiving bowl upwards.

Extending outwardly in two opposite directions from center portion 160 of supported spindle holding device 1 are two symmetrical elongated wing portions 158 and 159. The elongated wing portions 158 and 159 together with the center portion 160 make up the supported spindle holding device 1 of the instant invention. The elongated wing portions 158 and 159 are shaped such that the bottom side's 120 concave shape of each elongated wing portion permits the supported spindle holding device 1 to rest on the spinner's thighs. The top side 110 of the elongated wing portions 158 and 159 may follow the concave shape of the bottom side 120 of each elongated wing portion 158 and 159. The first end 161 and the second end 162 of supported spindle holding device 1 may be tapered or flat. The elongated wing portions 158 and 159 can be integral with the supported spindle holding device or may be removable. The removable elongated wing portions 158 and 159 can be attached to the center portion 160 by any attachment means, for example, by mortise and tenon.

The distance from top side 110 to bottom side 120 varies from the widest part of the body being the top of the center portion 160 to the bottom side 120. Such distance is called the thickness. As depicted in FIG. 1, the thickness of elongated wing portions 158 and 159 tapers from the thickest part being the portion closest to the center portion 160 to the thinnest part being at the first end 161 and second end 162. However, the thickness of elongated wing portions 158 and 159 may optionally be the same from the center portion 160 to the first end and the second end.

Figure 1A:
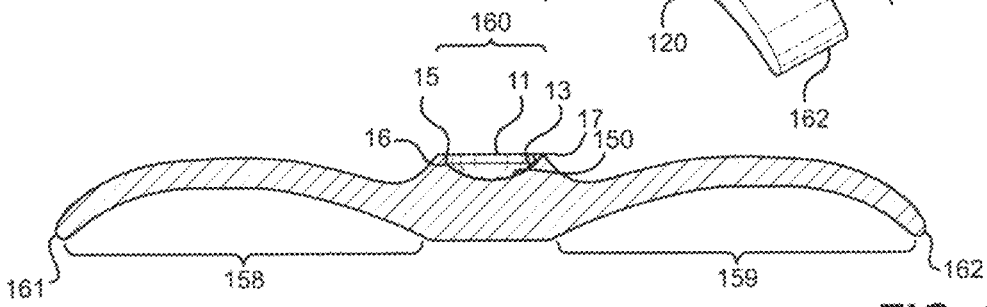
FIG. 1*a* depicts a body facing cross-cut view of a supported spindle holding device of the present invention.

FIG. 1*a* depicts a body facing side view of supported spindle holding device 1. This view shows center portion 160, elongated wing portions 158 and 159, first end 161 and second end 162. The center portion 160 includes an integrated receiving bowl 150. At the upper portion of the bowl wall 13, but below the bowl opening 11 is a lip 15. The lip 15 retains the spinning tip of the supported spindle within the confines of the receiving bowl 150 or it could retain a separate bowl. The lip 15 preferably runs the entire circumference of the bowl wall 13 and contains an upper lip portion 16 and a lower lip portion 17, wherein the upper lip portion 16 protrudes toward the center of the concave interior portion of the receiving bowl 150 and the lower portion extends inwards past the surface of bowl wall 13 from about 1/16 of an inch to about 3/4 of an inch, preferably about 1/8 of an inch. Preferably, the lip 15 is integral with the bowl wall 13. However, the lip 15 may be optionally a detachable ring that fits or snaps into or onto bowl wall 13.

Figure 1B:
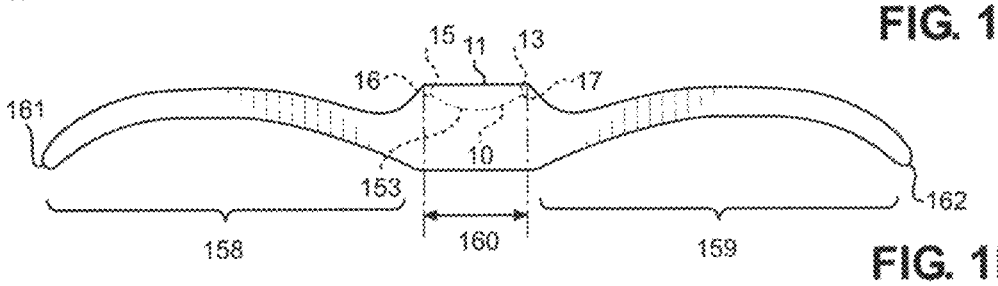
FIG. 1*b* depicts an away facing cross-cut view of a supported spindle holding device of the present invention.

FIG. 1*b* depicts an away facing side view of supported spindle holding device 1. This view shows center portion 160, elongated wing portions 158 and 159, first end 161 and second end 162 and length portion A. The center portion 160 includes an integrated receiving bowl 10. At the upper portion of the bowl wall 153, but below the bowl opening 11 is a lip 15. The lip 15 retains the spinning tip of the supported spindle within the confines of the receiving bowl 10. The lip 15 preferably runs the entire circumference of the bowl wall 13 and contains an upper lip portion 16 and a lower lip portion 17, wherein the upper lip portion 16 protrudes toward the center of the interior portion of the receiving bowl 10 and the lower portion extends inwards past the surface of bowl wall 13 from about 1/16 of an inch to about 3/4 of an inch, preferably about 1/8 of an inch. Preferably, the lip 15 is integral with the bowl wall 153. However, the lip 15 may be optionally a detachable ring that fits or snaps into or onto bowl wall 13.

Figure 1C:
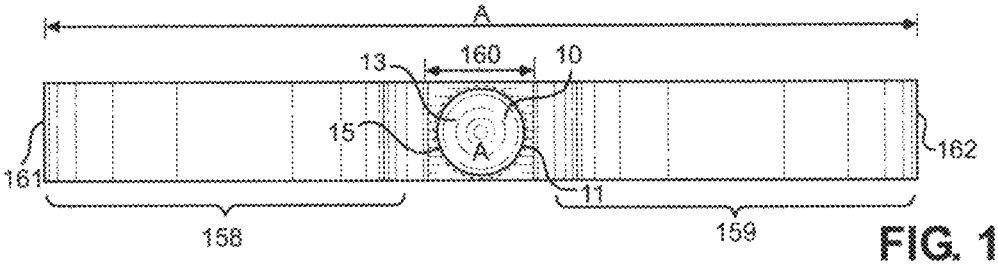
FIG. 1*c* depicts a top view of a supported spindle holding device of the present invention.

FIG. 1*c* depicts a top view of supported spindle holding device 1. This view shows center portion 160, elongated wing portions 158 and 159, first end 161 and second end 162. The center portion 160 includes an integrated receiving bowl 10 with a bowl opening 11. The lip 15 retains the spinning tip of the supported spindle within the confines of the receiving bowl 10. The lip 15 preferably runs the circumference of the bowl wall 13. The bowl opening 11 has a circumference and a diameter. It is preferred that the diameter is between from about 12 inches to about 1/16 inch, more preferable from about 5 inches and to about 1/8 inch, even more preferably from about 3 inches to about 1 inch, and most preferably about 1 5/8 inches.

Figure 1D:
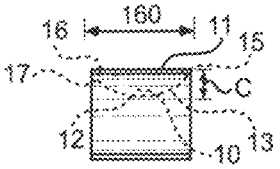
FIG. 1*d* depicts a cross-cut side view of a supported spindle holding device of the present invention.

FIG. 1*d* depicts a side cutout view of center portion 160. At the upper portion of the bowl wall 13, but below the bowl opening 11 is a lip 15. The lip 15 retains the spinning tip of the supported spindle within the confines of the receiving bowl 10. The lip 15 preferably runs the entire circumference of the bowl wall 13 and contains an upper lip portion 16 and a lower lip portion 17, wherein the upper lip portion 16 protrudes toward the concave interior portion of the receiving bowl 10 and the lower portion extends inwards past the surface of bowl wall 13 from about 1/16 of an inch to about 3/4 of an inch, preferably about 1/8 of an inch. Preferably, the lip 15 is integral with the bowl wall 13. However, the lip 15 may be optionally a detachable ring that fits or snaps into or onto bowl wall 13. The receiving bowl 10 has a depth portion C. The length of depth portion C may be of any depth but must be sufficient depth to receive the spinning tip of the supported spindle and maintain the spinning tip using the lip 15 within the receiving bowl 10. Such depth portion C may be from about 1/4 to about 2 inches, more preferable from about 5/16 to about 1 1/2 inches, even more preferably from about 1/2 to about 1 inch. Most preferably about 3/4 inch.

Figure 2:
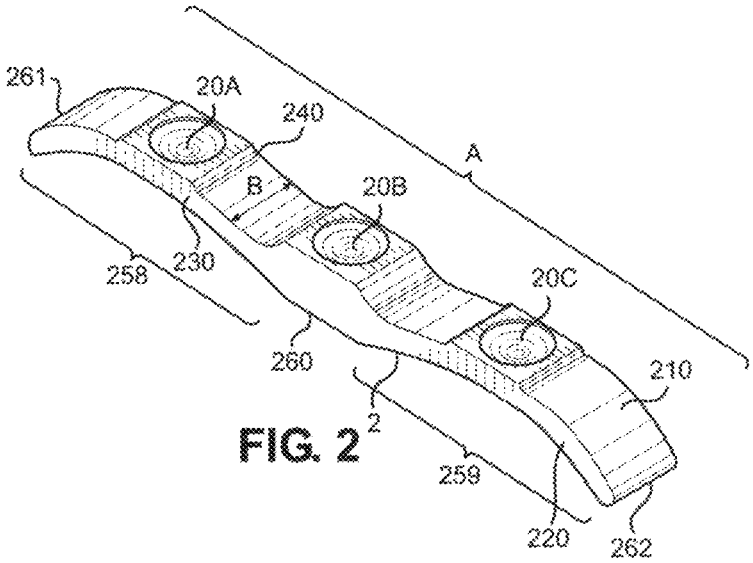
FIG. 2 depicts a view of a supported spindle holding device of the present invention.

FIG. 2 depicts a supported spindle holding device having an elongated body that is called supported spindle holding device 2 of the present invention having a top side 210 opposite a bottom side 220, a body facing side 230 connecting the top side 210 to the bottom side 220, and an away facing side 240 connecting the top side 210 to the bottom side 220. The top side 210 and bottom side 220 each having a length A and width B wherein the length is substantially long enough to cover both spinner's thighs while the spinner is seated and the width being between about 0.5 inch and 8 inches, preferably between about 1 inch and 6 inches, even more preferably between about 2 inches and 5 inches and most preferably between about 3 inches and 4 inches. Disposed on top side 210 substantially in the middle of length A and width B is receiving bowl 20*b*.

Extending outwardly in two opposite directions from the center portion 260 of supported spindle holding device 2 are two symmetrical elongated wing portions 258 and 259. The elongated wing portions 258 and 259 together with the center portion 260 make up the supported spindle holding device 2 of the instant invention. Each elongated wing portion 258 and 259 include an integrated receiving bowl 20*a* and 20*c*, respectively. Each receiving bowl 20*a*, 20*b*, and 20*c* are positioned about equidistant from each portion's ends and widths. The elongated wing portions 258 and 259 are shaped such that the bottom side's 220 concave shape of each elongated wing portion permits the supported spindle holding device 2 to rest on the spinner's thighs. The top side 210 of the elongated wing portions 258 and 259 may follow the concave shape of the bottom side 220 of each elongated wing portion 258 and 259. The first end 261 and the second end 262 of supported spindle holding device 2 may be tapered or flat. The elongated wing portions 258 and 259 can be integral with the supported spindle holding device 2 or may be removable. The removable elongated wing portions 258 and 259 can be attached to the center portion 260 by any attachment means, for example, by mortise and tenon.

The distance of the body of the supported spindle holding device 2 from top side 210 to bottom side 220 varies from the widest part being the top of the center portion 250 to the bottom side 220. Such distance is called the thickness. As depicted in FIG. 2, the thickness of elongated wing portions 258 and 259 tapers from the thickest part being the portion closest to the center portion 260 to the thinnest part being at the first end 261 and second end 262. However, the thickness of elongated wing portions 258 and 259 may optionally be the same from the center portion 260 to the first end and the second end.

Figure 2A:
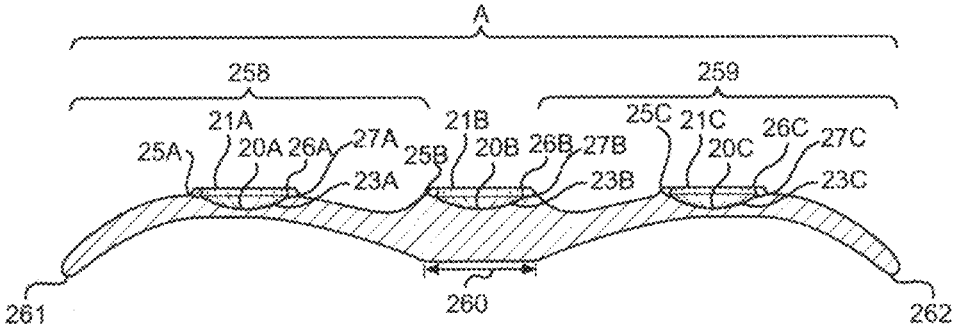
FIG. 2*a* depicts a body facing cross-cut view of a supported spindle holding device of the present invention.

FIG. 2*a* depicts a body side view of supported spindle holding device 2. This view shows center portion 260, elongated wing portions 258 and 259, first end 261 and second end 262. The center portion 260 includes an integrated receiving bowl 20*b*. At the upper portion of the bowl wall 23*b*, but below the bowl opening 21*b* is a lip 25*b*. The lip 25*b* retains the spinning tip of the supported spindle within the confines of the receiving bowl 20*b*. The lip 25*b* preferably runs the entire circumference of the bowl wall 23*b* and contains an upper lip portion 26*b* and a lower lip portion 27*b*, wherein the upper lip portion 26*b* protrudes toward the interior portion of the receiving bowl 20*b* and the lower portion extends inwards past the surface of bowl wall 23*b* from about 1/16 of an inch to about 3/4 of an inch, preferably about 1/8 of an inch. Preferably, the lip 25*b* is integral with the bowl wall 23*b*. However, the lip 25*b* may be optionally a detachable ring that fits or snaps into or onto bowl wall 23*b*.

Each elongated wing portion 258 and 259 includes an integrated receiving bowl 20*a* in elongated wing portion 258 and integrated receiving bowl 20*c* in elongated wing portion 259. For receiving bowl 20*a*, at the upper portion of the bowl wall 23*a*, but below the bowl opening 21*a* is a lip 25*a*. The lip 25*a* retains the spinning tip of the supported spindle within the confines of the receiving bowl 20*a*. The lip 25*a* preferably runs the entire circumference of the bowl wall 23*a* and contains an upper lip portion 26*a* and a lower lip portion 27*a*, wherein the upper lip portion 26*a* protrudes toward the concave interior portion of the receiving bowl 20*a* and the lower portion extends inwards past the surface of bowl wall 23*a* from about 1/16 of an inch to about 3/4 of an inch, preferably about 1/8 of an inch. Preferably, the lip 25*a* is integral with the bowl wall 23*a*, However, the lip 25*a* may be optionally a detachable ring that fits or snaps into or onto bowl wall 23*a*.

For receiving bowl 20*c*, at the upper portion of the bowl wall 23*c*, but below the bowl opening 21*c* is a lip 25*c*. The lip 25*c* retains the spinning tip of the supported spindle within the confines of the receiving bowl 20*c*. The lip 25*c* preferably runs the entire circumference of the bowl wall 23*c* and contains an upper lip portion 26*c* and a lower lip portion 27*c*, wherein the upper lip portion 26*c* protrudes toward the center of the concave interior portion of the receiving bowl 20*c* and the lower portion extends inwards past the surface of bowl wall 23*c* from about 1/16 of an inch to about 3/4 of an inch, preferably about 1/8 of an inch. Preferably, the lip 25*c* is integral with the bowl wall 23*c*. However, the lip 25*c* may be optionally a detachable ring that fits or snaps into or onto bowl wall 23*c*.

Figure 2B:
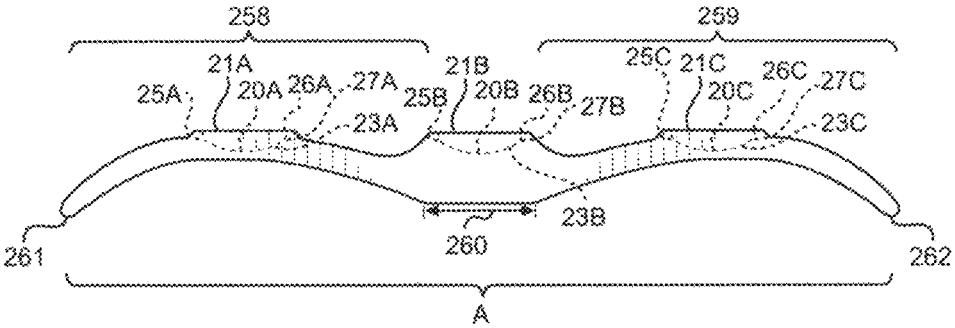
FIG. 2*b* depicts an away facing cross-cut view of a supported spindle holding device of the present invention.

FIG. 2*b* depicts an away facing side view of supported spindle holding device 2. This view shows center portion 260, elongated wing portions 258 and 259, first end 261 and second end 262 and length portion A. The center portion 260 includes an integrated receiving bowl 20*b*. At the upper portion of the bowl wall 23*b*, but below the bowl opening 21*b* is a lip 25*b*. The lip 25*b* retains the spinning tip of the supported spindle within the confines of the receiving bowl 20*b*. The lip 25*b* preferably runs the entire circumference of the bowl wall 23*b* and contains an upper lip portion 26*b* and a lower lip portion 27*b*, wherein the upper lip portion 26*b* protrudes toward the concave interior portion of the receiving bowl 20*b* and the lower portion extends inwards past the surface of bowl wall 23*b* from about 1/16 of an inch to about 3/4 of an inch, preferably about 1/8 of an inch. Preferably, the lip 25*b* is integral with the bowl wall 23*b*. However, the lip 25*b* may be optionally a detachable ring that fits or snaps into or onto bowl wall 23*b*.

This view also shows receiving bowl 20*a* in elongated wing portion 258 and receiving bowl 20*c* in elongated wing portion 259. Integrated receiving bowl 20*a* with a bowl opening 21*a*. The lip 25*a* retains the spinning tip of the supported spindle within the confines of the receiving bowl 20*a*. The lip 25*a* preferably runs the entire circumference of the bowl wall 23*a*. The bowl opening 21*a* has a circumference and a diameter. It is preferred that the diameter is between from about 12 inches to about 1/16 inch, more preferable from about 5 inches and to about 1/8 inch, even more preferably from about 3 inches to about 1 inch, and most preferably about 1 5/8 inches.

Integrated receiving bowl 20*c* includes a bowl opening 21*c*. The lip 25*c* on bowl wall 23*c* retains the spinning tip of the supported spindle within the confines of the receiving bowl 20*c*. The lip 25*c* preferably runs the entire circumference of the bowl wall 23*c*. The bowl opening 21*c* has a circumference and a diameter. It is preferred that the diameter is between from about 12 inches to about 1/16 inch, more preferable from about 5 inches and to about 1/8 inch, even more preferably from about 3 inches to about 1 inch, and most preferably about 1 5/8 inches.

Figure 2C:
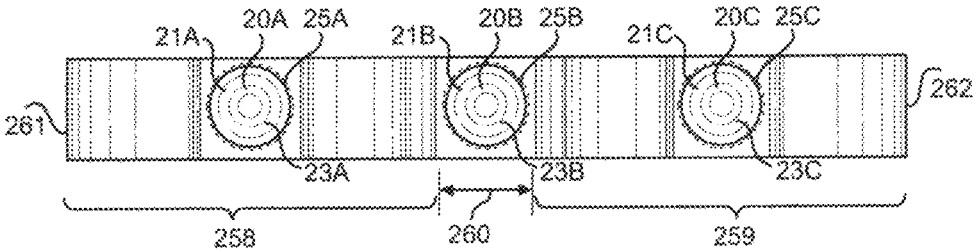
FIG. 2*c* depicts a top view of a supported spindle holding device of the present invention.

FIG. 2*c* depicts a top view of supported spindle holding device 2. This view shows center portion 260, elongated wing portions 258 and 259, first end 261 and second end 262, including length A and width B. The center portion 260 includes an integrated receiving bowl 20*b* with a bowl opening 21*b*. The lip 25*b* retains the spinning tip of the supported spindle within the confines of the receiving bowl 20*b*. The lip 25*b* preferably runs the entire circumference of the bowl wall 23*b*. The bowl opening 21*b* has a circumference and a diameter. It is preferred that the diameter is between from about 12 inches to about 1/16 inch, more preferable from about 5 inches and to about 1/8 inch, even more preferably from about 3 inches to about 1 inch, and most preferably about 1 5/8 inches.

This view also shows receiving bowl 20*a* in elongated wing portion 258 and receiving bowl 20*c* in elongated wing portion 259. Integrated receiving bowl 20*a* with a bowl opening 21*a*. The lip 25*a* retains the spinning tip of the supported spindle within the confines of the receiving bowl 20*a*. The lip 25*a* preferably runs the entire circumference of the bowl wall 23*a*. The bowl opening 21*a* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

In FIG. 2*c*, integrated receiving bowl 20*c* with a bowl opening 21*c*. The lip 25*c* retains the spinning tip of the supported spindle within the confines of the receiving bowl 20*c*. The lip 25*c* preferably runs the entire circumference of the bowl wall 23*c*. The bowl opening 21*c* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

Figure 2D:
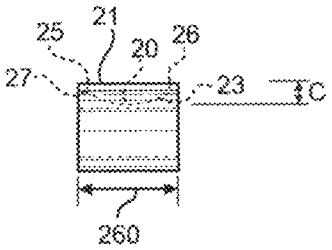
FIG. 2*d* depicts a cross-cut side view of a supported spindle holding device of the present invention.

FIG. 2*d*. depicts a side cutout view of center portion 260 as representative of an integrated receiving bowl 20. At the upper portion of the bowl wall 23, but below the bowl opening 21 is a lip 25. The lip 25 retains the spinning tip of the supported spindle within the confines of the receiving bowl 20. The lip 25 preferably extends the entire circumference of the bowl wall 23 and contains an upper lip portion 26 and a lower lip portion 27, wherein the upper lip portion 26 protrudes toward the concave interior portion of the receiving bowl 20 and the lower portion extends inwards past the surface of bowl wall 23 from about 1/16 of an inch to about 3/4 of an inch, preferably about 1/8 of an inch. Preferably, the lip 25 is integral with the bowl wall 23. However, the lip 25 may be optionally a detachable ring that fits or snaps into or onto bowl wall 23. The receiving bowl 20 has a depth portion C. The length of depth portion C may be of any depth but must be sufficient depth to receive the spinning tip of the supported spindle and maintain the spinning tip using the lip 25 within the receiving bowl 20. Such depth portion C may be from about 1/4 to about 2 inches, more preferable from about 5/16 to about 1 1/2 inches, even more preferably from about 1/2 to about 1 inch. Most preferably about 3/4 inch.

Figure 3:
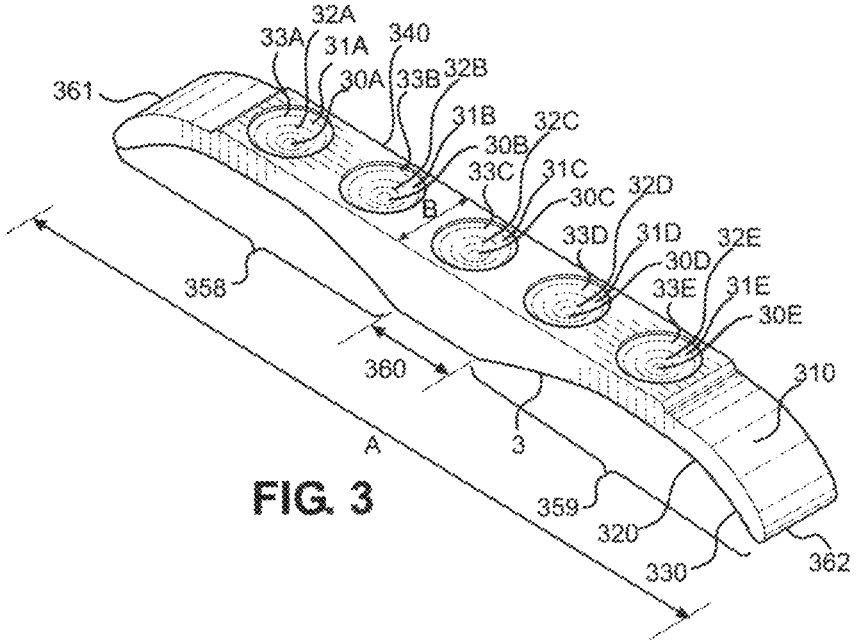
FIG. 3 depicts an overhead view of a supported spindle holding device of the present invention.

FIG. 3 depicts a supported spindle holding device having a body that is a supported spindle holding device 3 of the present invention having a top side 310 opposite a bottom side 320, a body facing side 330 connecting the top side 310 to the bottom side 320, and an away facing side 340 connecting the top side 310 to the bottom side 320. The top side 310 and bottom side 320 each having a length A and width B wherein the length is substantially long enough to cover both spinner's thighs while the spinner is seated and the width being between about 0.5 inch and 8 inches, preferably between about 1 inch and 6 inches, even more preferably between about 2 inches and 5 inches and most preferably between about 3 inches and 4 inches. Disposed on top side 310 substantially in the middle of width B is a plurality of receiving bowls 30*a*, 30*b*, 30*c*, 30*d*, and 30*e*.

Receiving bowls 30*a*, 30*b*, 30*c*,30*d*, and 30*e* are integrated in supported spindle holding device 3 and each includes a bowl opening 31, a bowl bottom 32, and a bowl wall 33 that spans the bowl opening 31 to the bowl bottom 32 and forms the concave interior portion of the bowl. Optionally, receiving bowls 30*a*, 30*b*, 30*c*, 30*d*, and 30*e* may be removable from the supported spindle holding device 3 by using a means for removably attaching receiving bowls 30*a*, 30*b*, 30*c*, 30*d*, and 30*e* to the supported spindle holding device 3, which is not depicted. Means for removably attaching receiving bowls 30*a*, 30*b*, 30*c*, 30*d*, and 30*e* to the supported spindle holding device 3 include hook and loop fastening tape, adhesive tape, screws, nails, keel on the receiving bowls 30*a*, 30*b*, 30*c*, 30*d*, and 30*e* and slots in supported spindle holding device 3 and the like. Also, when a removable receiving bowl is used, it may include means for adjusting the height of the receiving bowl upwards from the top side 310. While all receiving bowls on supported spindle holding device 3 may be removable, it is optional that one or more of the receiving bowls 30*a*, 30*b*, 30*c*, 30*d*, and 30*e* are removable and the remaining receiving bowls 30*a*, 30*b*, 30*c*, 30*d*, and 30*e* are integral in supported spindle holding device 3.

Extending outwardly in two opposite directions from the center portion 360 of supported spindle holding device 3 are two symmetrical elongated wing portions 358 and 359. The elongated wing portions 358 and 359 together with the center portion 360 make up the supported spindle holding device 3 of the present invention. The elongated wing portions 358 and 359 are shaped such that the bottom side 320 concave shape of each elongated wing portion permits the supported spindle holding device 3 to rest on the spinner's thighs. The top side 310 of the elongated wing portions 358 and 359 may follow the concave shape of the bottom side 320 of each elongated wing portion 358 and 359. The first end 361 and the second end 362 of supported spindle holding device 3 may be tapered or flat. The elongated wing portions 358 and 359 can be integral with the supported spindle holding device 3 or may be removable. The removable elongated wing portions 358 and 359 can be attached to the center portion 360 by any attachment means, for example, by mortise and tenon.

The distance from top side 310 to bottom side 320 varies from the widest part being the top of the center portion 360 to the bottom side 320. Such distance is called the thickness. As depicted in FIG. 3, the thickness of elongated wing portions 358 and 359 tapers from the thickest part being the portion closest to the center portion 360 to the thinnest part being at the first end 361 and second end 362. However, the thickness of elongated wing portions 358 and 359 may optionally be the same from the center portion 360 to the first end and the second end.

Figure 3A:
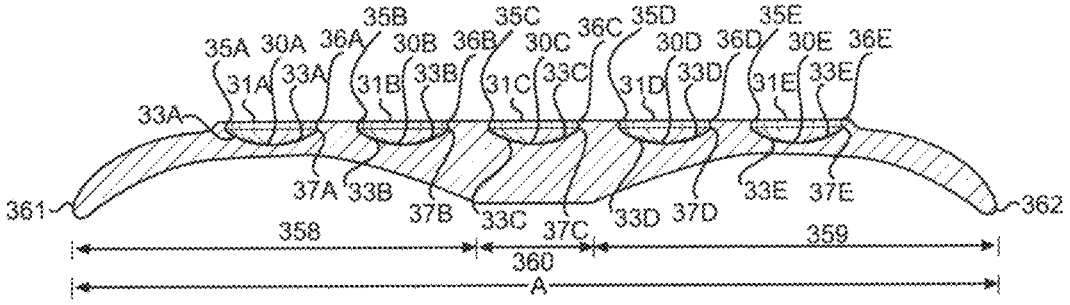
FIG. 3*a* depicts a body facing cross-cut view of a supported spindle holding device of the present invention.

FIG. 3*a* depicts a body side view of supported spindle holding device 3. This view shows center portion 360, elongated wing portions 358 and 359, first end 361 and second end 362. This view depicts center portion 360 that includes an integrated receiving bowl 30*c*. At the upper portion of the bowl wall 33*c*, but below the bowl opening 31*c* is a lip 35*c*. The lip 35*c* retains the spinning tip of the supported spindle within the confines of the receiving bowl 30*c*. The lip 35*c* preferably runs the entire circumference of the bowl wall 33*c* and contains an upper lip portion 36*c* and a lower lip portion 37*c*, wherein the upper lip portion 36*c* protrudes toward the concave interior portion of the receiving bowl 30*c* and the lower portion extends inwards past the surface of bowl wall 33*c* from about 1/16 of an inch to about 3/4 of an inch, preferably about 1/8 of an inch. Preferably, the lip 35*c* is integral with the bowl wall 33*c*. However, the lip 35*c* may be optionally a detachable ring that fits or snaps into or onto bowl wall 33*c*.

Each elongated wing portion 358 and 359 includes two integrated receiving bowls respectively; 30*a* and 30*b* in elongated wing portion 358 and 30*d* and 30*e* in elongated wing portion 359. For receiving bowl 30*a*, at the upper portion of the bowl wall 33*a*, but below the bowl opening 31*a* is a lip 35*a*. The lip 35*a* retains the spinning tip of the supported spindle within the confines of the receiving bowl 30*a*. The lip 35*a* preferably runs the entire circumference of the bowl wall 33*a* and contains an upper lip portion 36*a* and a lower lip portion 37*a*, wherein the upper lip portion 36*a* protrudes toward the center of the concave interior portion of the receiving bowl 30*a* and the lower portion extends inwards past the surface of bowl wall 33*a* from about 1/16 of an inch to about 3/4 of an inch, preferably about 1/8 of an inch. Preferably, the lip 35*a* is integral with the bowl wall 33*a*. However, the lip 35*a* may be optionally a detachable ring that fits or snaps into or onto bowl wall 33*a*.

For receiving bowl 30*b*, at the upper portion of the bowl wall 33*b*, but below the bowl opening 31*b* is a lip 35*b*. The lip 35*b* retains the spinning tip of the supported spindle within the confines of the receiving bowl 30*b*. The lip 35*b* preferably runs the entire circumference of the bowl wall 33*b* and contains an upper lip portion 36*b* and a lower lip portion 37*b*, wherein the upper lip portion 36*b* protrudes toward the center of the concave interior portion of the receiving bowl 30*b* and the lower portion extends inwards past the surface of bowl wall 33*b* from about 1/16 of an inch to about 3/4 of an inch, preferably about 1/8 of an inch. Preferably, the lip 35*b* is integral with the bowl wall 33*b*. However, the lip 35*b* may be optionally a detachable ring that fits or snaps into or onto bowl wall 33*b*.

For receiving bowl 30*d*, at the upper portion of the bowl wall 33*d*, but below the bowl opening 31*d* is a lip 35*d*. The lip 35*d* retains the spinning tip of the supported spindle within the confines of the receiving bowl 30*d*. The lip 35*d* preferably runs the entire circumference of the bowl wall 33*d* and contains an upper lip portion 36*d* and a lower lip portion 37*d*, wherein the upper lip portion 36*d* protrudes toward the center of the concave interior portion of the receiving bowl 30*d* and the lower portion extends inwards past the surface of bowl wall 31*d* from about 1/16 of an inch to about 3/4 of an inch, preferably about 1/8 of an inch. Preferably, the lip 35*d* is integral with the bowl wall 33*d*. However, the lip 35*d* may be optionally a detachable ring that fits or snaps into or onto bowl wall 33*d*.

For receiving bowl 30*e*, at the upper portion of the bowl wall 33*e*, but below the bowl opening 31*e* is a lip 35*e*. The lip 35*e* retains the spinning tip of the supported spindle within the confines of the receiving bowl 30*e*. The lip 35*e* preferably runs the entire circumference of the bowl wall 33*e* and contains an upper lip portion 36*e* and a lower lip portion 37*e*, wherein the upper lip portion 36*e* protrudes toward the center of the concave interior portion the receiving bowl 30*e* and the lower portion extends inwards past the surface of bowl wall 33*e* from about 1/16 of an inch to about 3/4 of an inch, preferably about 1/8 of an inch. Preferably, the lip 35*e* is integral with the bowl wall 33*e*. However, the lip 35*e* may be optionally a detachable ring that fits or snaps into or onto bowl wall 33*e*.

Figure 3B:
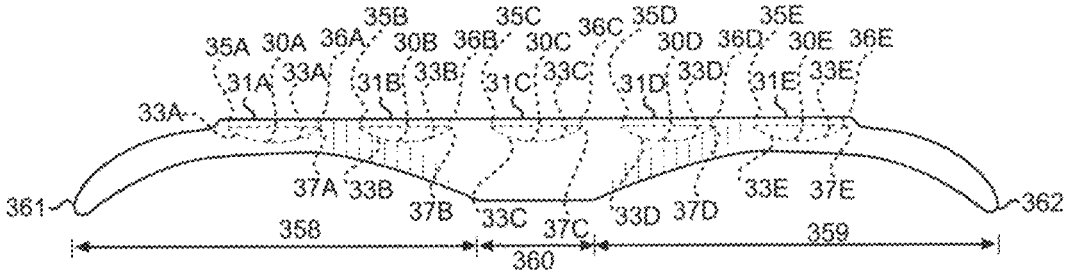
FIG. 3*b* depicts an away facing cross-cut view of a supported spindle holding device of the present invention.

FIG. 3*b* depicts an away facing side view of supported spindle holding device 3. This view shows center portion 360, elongated wing portions 358 and 359, first end 361 and second end 362 and length portion A. Supported spindle holding device 3 includes five integrated receiving bowls; 30*a*, 30*b*, 30*c*, 30*d*, and 30*e*. For receiving bowl 30*a*, at the upper portion of the bowl wall 33*a*, but below the bowl opening 31*a* is a lip 35*a*. The lip 35*a* retains the spinning tip of the supported spindle within the confines of the receiving bowl 30*a*. The lip 35*a* preferably runs the entire circumference of the bowl wall 33*a* and contains an upper lip portion 36*a* and a lower lip portion 37*a*, wherein the upper lip portion 36*a* protrudes toward the center of the concave interior portion of the receiving bowl 30*a* and the lower lip portion 37*a* that extends inwards past the surface of bowl wall 33*a* from about 1/16 of an inch to about 3/4 of an inch, preferably about 1/8 of an inch. Preferably, the lip 35*a* is integral with the bowl wall 33*a*. However, the lip 35*a* may be optionally a detachable ring that fits or snaps into or onto bowl wall 33*a*.

For receiving bowl 30*b*, at the upper portion of the bowl wall 33*b*, but below the bowl opening 31*b* is a lip 35*b*. The lip 35*b* retains the spinning tip of the supported spindle within the confines of the receiving bowl 30*b*. The lip 35*b* preferably runs the entire circumference of the bowl wall 33*b*. The bowl opening 31*b* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

For receiving bowl 30*c*, at the upper portion of the bowl wall 33*c*, but below the bowl opening 31*c* is a lip 35*c*. The lip 35*c* retains the spinning tip of the supported spindle within the confines of the receiving bowl 30*c*. The lip 35*c* preferably runs the entire circumference of the bowl wall 33*c*. The bowl opening 31*c* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

For receiving bowl 30*d*, at the upper portion of the bowl wall 33*d*, but below the bowl opening 31*d* is a lip 35*d*. The lip 35*d* retains the spinning tip of the supported spindle within the confines of the receiving bowl 30*d*. The lip 35*d* preferably runs the entire circumference of the bowl wall 33*d*. The bowl opening 31*d* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

For receiving bowl 30*e*, at the upper portion of the bowl wall 33*e*, but below the bowl opening 31*e* is a lip 35*e*. The lip 35*e* retains the spinning tip of the supported spindle within the confines of the receiving bowl 30*e*. The lip 35*e* is a preferably runs the entire circumference of the bowl wall 33*e*. The bowl opening 31*e* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

Figure 3C:
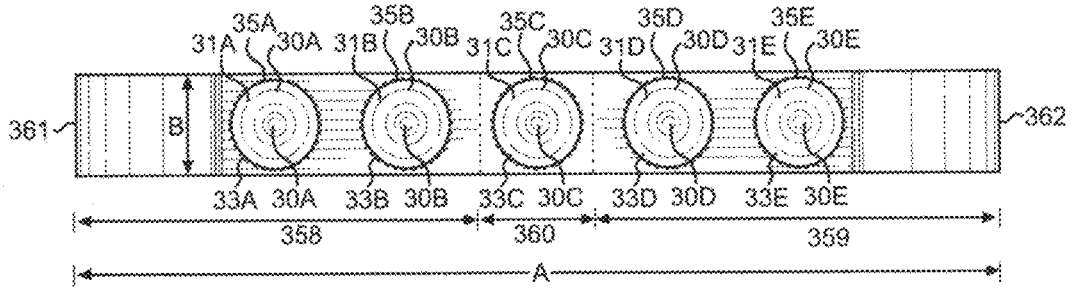
FIG. 3*c* depicts a top view of a supported spindle holding device of the present invention.

FIG. 3*c* depicts a top view of supported spindle holding device 3. This view shows center portion 360 on bottom side, elongated wing portions 358 and 359 outwardly extending, first end 361 and second end 362, including length A and width B. Supported spindle holding device 3 includes five integrated receiving bowls 30*a*, 30*b*, 30*c*, 30*d* and 30*e*, each being equidistant apart from the bowl next to it.

Receiving bowl 30*a* has an opening 31*a* and a lip 35*a*. The lip 35*a* retains the spinning tip of the supported spindle within the confines of the receiving bowl 30*a*. The lip 35*a* preferably runs the entire circumference of the bowl wall 33*a*. The bowl opening 31*a* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

Integrated receiving bowl 30*b* includes a bowl opening 31*b* and lip 35*b*. The lip 35*b* retains the spinning tip of the supported spindle within the confines of the receiving bowl 30*b*. The lip 35*b* preferably runs the entire circumference of the bowl wall 33*b*. The bowl opening 31*b* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

Integrated receiving bowl 30*c* includes a bowl opening 31*c* and lip 35*c*. The lip 35*c* retains the spinning tip of the supported spindle within the confines of the receiving bowl 30*c*. The lip 35*c* preferably runs the entire circumference of the bowl wall 33*c*. The bowl opening 31*c* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

Integrated receiving bowl 30*d* includes a bowl opening 31*d* and lip 35*d*. The lip 35*d* retains the spinning tip of the supported spindle within the confines of the receiving bowl 30*d*. The lip 35*d* preferably runs the entire circumference of the bowl wall 33*d*. The bowl opening 31*d* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

Integrated receiving bowl 30*e* includes a bowl opening 31*e* and lip 35*e*. The lip 35*e* retains the spinning tip of the supported spindle within the confines of the receiving bowl 30*e*. The lip 35*e* is a preferably runs the entire circumference of the bowl wall 33*e*. The bowl opening 31*e* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

Figure 3D:
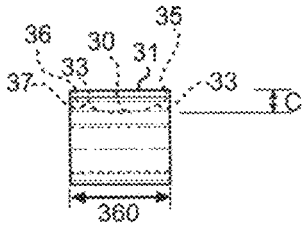
FIG. 3*d* depicts a cross-cut side view of a supported spindle holding device of the present invention.

FIG. 3*d* depicts a side cutout view supported spindle holding device 3 containing a receiving bowl 30 as representative of the integrated receiving bowls 30*a*, 30*b*, 30*c*, 30*d* and 30*e*. At the upper portion of the bowl wall 33, but below the bowl opening 31 is a lip 35. The lip 35 retains the spinning tip of the supported spindle within the confines of the receiving bowl 30. The lip 35 preferably runs the entire circumference of the bowl wall 33 and contains an upper lip portion 36 and a lower lip portion 37, wherein the upper lip portion 36 protrudes toward the center of the concave interior portion of the receiving bowl 30 and the lower portion extends inwards past the surface of bowl wall 33 from about 1/16 of an inch to about 3/4 of an inch, preferably about 1/8 of an inch. Preferably, the lip 35 is integral with the bowl wall 33. However, the lip 35 may be optionally a detachable ring that fits or snaps into or onto bowl wall 33. The receiving bowl 30 has a depth portion C. The length of depth portion C may be of any depth but must be sufficient depth to receive the spinning tip of the supported spindle and maintain the spinning tip using the lip 35 within the receiving bowl 30. Such depth portion C may be from about 1/4 to about 2 inches, more preferable from about 5/16 to about 1 1/2 inches, even more preferably from about 1/2 to about 1 inch. Most preferably about 3/4 inch.

Figure 4:
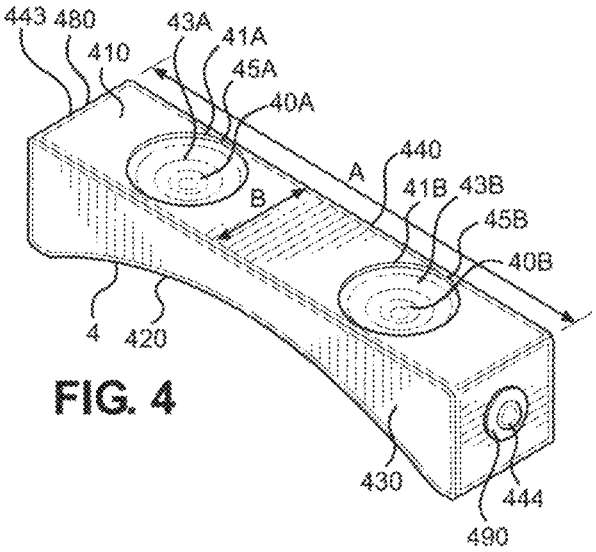
FIG. 4 depicts an overhead view of a supported spindle holding device of the present invention.

FIG. 4 depicts a supported spindle holding device having a body that is a supported spindle holding device 4 of the present invention having a top side 410 opposite a bottom side 420, a body facing side 430 connecting the top side 410 to the bottom side 420, and an away facing side 440 connecting the top side 410 to the bottom side 420. The top side 410 and bottom side 420 each having a length A and width B wherein the length is substantially long enough to cover a single thigh of a spinner while the spinner is seated and the width being between about 0.5 inch and about 8 inches, preferably between about 1 inch and about 6 inches, even more preferably between about 2 inches and about 5 inches and most preferably between about 3 inches and about 4 inches. Disposed on top side 410 substantially in the middle of length A and width B are receiving bowls 40*a* and 40*b*. Alternatively, supported spindle holding device 4 can have one receiving bowl 40 instead of receiving bowls 40*a* and 40*b*.

For receiving bowl 40*a*, at the upper portion of the bowl wall 43*a*, but below the bowl opening 41*a* is a lip 45*a*. The lip 45*a* retains the spinning tip of the supported spindle within the confines of the receiving bowl 40*a*. The lip 45*a* preferably runs the entire circumference of the bowl wall 43*a*. The bowl opening 41*a* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

For receiving bowl 40*b*, at the upper portion of the bowl wall 43*b*, but below the bowl opening 41*b* is a lip 45*b*. The lip 45*b* retains the spinning tip of the supported spindle within the confines of the receiving bowl 40*b*. The lip 45*b* preferably runs the entire circumference of the bowl wall 43*b*. The bowl opening 41*b* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

The supported spindle holding device 4 is designed to rest on a single thigh of the spinner when in use. Alternately, the supported spindle holding device may rest on a preferably flat surface. While the supported spindle holding device may rest on a single thigh of the spinners without additional securing aids, it is preferable that a leg securing means, such as a strap, belt, or rope, be used to further secure the supported spindle holding device on the thigh of the spinner's leg. Such leg securing means can be releasably attached to leg securing means 443 and 444 that are attached to first attachment end 480 and second attachment end 490. For example, an elongated strap having a length and a width may be used. The length of the elongated strap has two terminal ends. While the supported spindle holding device is resting on a single thigh of the spinner, a first terminal end of the strap is fed through a loop on the leg securing means on the first attachment end 480 then under a single thigh of the spinner, and then fed through a loop on the leg securing means on the second attachment end 490. The two terminal ends of the strap are then releasable secured to each other. Such securing may be by hook and loop fastening tape, adhesive tape, snaps, buckles and the like.

The distance of the body of the supported spindle holding device from top side 410 to bottom side 420 varies from the widest part being at the first end and the second end. Such distance is called the thickness. As depicted in FIG. 4, the thickness tapers from the thickest part at the first end and the second end to the center region being the least thick. This provides the concave shape of the bottom side that is needed to rest the supported spindle holding device on the spinner's thigh.

Figure 4A:
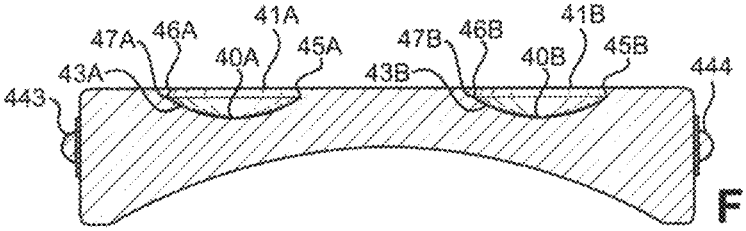
FIG. 4*a* depicts a body facing cross-cut view of a supported spindle holding device of the present invention.

FIG. 4*a* depicts a body facing side view of supported spindle holding device 4. This view shows integrated receiving bowls 40*a* and 40*b*, respectively. Receiving bowl 40*a* has a bowl opening 41*a* with upper portion of the bowl wall 43*a* containing a lip 45*a*. The lip 45*a* retains the spinning tip of the supported spindle within the confines of the receiving bowl 40*a*. The lip 45*a* preferably runs the entire circumference of the bowl wall 43*a* and contains an upper lip portion 46*a* and a lower lip portion 47*a*, wherein the upper lip portion 46*a* protrudes toward the center of the concave interior portion of the receiving bowl 40*a* and the lower portion extends inwards past the surface of bowl wall 43*a* from about 1/16 of an inch to about 3/4 of an inch, preferably about 1/8 of an inch. Preferably, the lip 45*a* is integral with the bowl wall 43*a*. However, the lip 45*a* may be optionally a detachable ring that fits or snaps into or onto bowl wall 43*a*.

Receiving bowl 40*b* has an interior bowl opening 41*b* with upper portion of the bowl wall 43*b* containing a lip 45*b*. The lip 45*b* retains the spinning tip of the supported spindle within the confines of the receiving bowl 40*b*. The lip 45*b* preferably runs the entire circumference of the bowl wall 43*b* and contains an upper lip portion 46*b* and a lower lip portion 47*b*, wherein the upper lip portion 46*b* protrudes toward the center of the concave interior portion of the receiving bowl 40*b* and the lower portion extends inwards past the surface of bowl wall 43*b* from about 1/16 of an inch to about 3/4 of an inch, preferably about 1/8 of an inch. Preferably, the lip 45*b* is integral with the bowl wall 43*b*. However, the lip 45*b* may be optionally a detachable ring that fits or snaps into or onto bowl wall 43*b*.

Figure 4B:
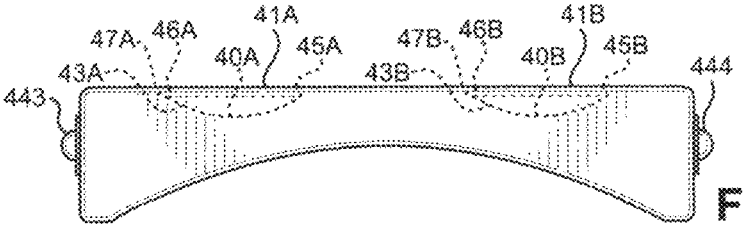
FIG. 4*b* depicts an away facing cross-cut view of a supported spindle holding device of the present invention.

FIG. 4*b* depicts an away facing side view of supported spindle holding device 4. This view shows integrated receiving bowls 40*a* and 40*b*, respectively. Receiving bowl 40*a* has a bowl opening 41*a* with upper portion of the bowl wall 43*a* containing a lip 45*a*. The lip 45*a* retains the spinning tip of the supported spindle within the confines of the receiving bowl 40*a*. The lip 45*a* preferably runs the entire circumference of the bowl wall 43*a* and contains an upper lip portion 46*a* and a lower lip portion 47*a*, wherein the upper lip portion 46*a* protrudes toward the center of the concave interior portion of the receiving bowl 40*a* and the lower portion extends inwards past the surface of bowl wall 43*a* from about 1/16 of an inch to about 3/4 of an inch, preferably about 1/8 of an inch. Preferably, the lip 45*a* is integral with the bowl wall 43*a*. However, the lip 45*a* may be optionally a detachable ring that fits or snaps into or onto bowl wall 43*a*.

Receiving bowl 40*b* has an interior bowl opening 41*b* with upper portion of the bowl wall 43*b* containing a lip 45*b*. The lip 45*b* retains the spinning tip of the supported spindle within the confines of the receiving bowl 40*b*. The lip 45*b* preferably runs the entire circumference of the bowl wall 43*b* and contains an upper lip portion 46*b* and a lower lip portion 47*b*, wherein the upper lip portion 46*b* protrudes toward the center of the concave interior portion of the receiving bowl 40*b* and the lower portion extends inwards past the surface of bowl wall 43*b* from about 1/16 of an inch to about 3/4 of an inch, preferably about 1/8 of an inch. Preferably, the lip 45*b* is integral with the bowl wall 43*b*. However, the lip 45*b* may be optionally a detachable ring that fits or snaps into or onto bowl wall 43*b*.

Figure 4C:
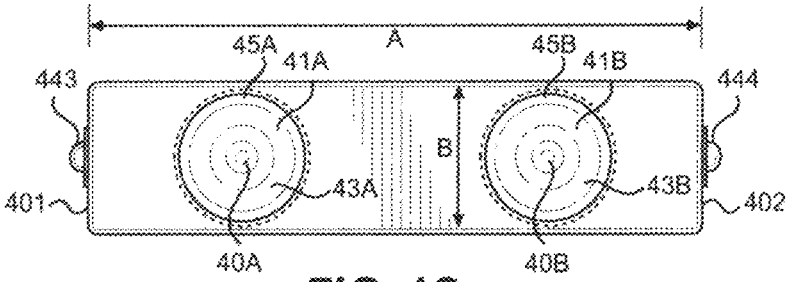
FIG. 4*c* depicts a top view of a supported spindle holding device of the present invention.

FIG. 4*c* depicts a top view of supported spindle holding device 4. This view shows length A and width B, first end 401 and second end 402. Integrated receiving bowls 40*a* and 40*b* are depicted with opening 41*a* for receiving bowl 40*a* and opening 41*b* for receiving bowl 40*b*. Also shown is lip 45*a* and lip 45*b*. The lip 45*a* and 45*b* retains the spinning tip of the supported spindle within the confines of the receiving bowl 40*a* and receiving bowl 40*b*. The lip 45*a* and 45*b* preferably runs the entire circumference of the bowl wall 43*a* and 43*b* respectively. The bowl openings 41*a* and 41*b* have a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches. Attachment areas for leg securing means attachments are depicted at first end 401 and second end 402.

Figure 4D:
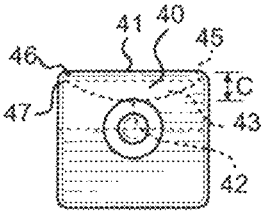
FIG. 4*d* depicts a cross-cut side view of a supported spindle holding device of the present invention.

FIG. 4*d* depicts a side cutout view supported spindle holding device 4 containing a receiving bowl 40 as representative of the integrated receiving bowls 40*a* and 40*b*. At the upper portion of the bowl wall 43, but below the bowl opening 41 is a lip 45. The lip 45 retains the spinning tip of the supported spindle within the confines of the receiving bowl 40. The lip 45 preferably runs the entire circumference of the bowl wall 43 and contains an upper lip portion 46 and a lower lip portion 47, wherein the upper lip portion 46 protrudes toward the center of the concave interior portion of the receiving bowl 40 and the lower portion extends inwards past the surface of bowl wall 43 from about 1/16 of an inch to about 3/4 of an inch, preferably about 1/8 of an inch. Preferably, the lip 45 is integral with the bowl wall 43. However, the lip 45 may be optionally a detachable ring that fits or snaps into or onto bowl wall 43. The receiving bowl 40 has a depth portion C. The length of depth portion C may be of any depth but must be sufficient depth to receive the spinning tip of the supported spindle and maintain the spinning tip using the lip 45 within the receiving bowl 40. Such depth portion C may be from about 1/4 to about 2 inches, more preferable from about 5/16 to about 1 1/2 inches, even more preferably from about 1/2 to about 1 inch. Most preferably about 3/4 inch.

Receiving bowl 40 is an integrated substantially bowl or cup that is the concave portion of supported spindle holding device 4, which includes a bowl opening 41, a bowl bottom 42, and a bowl wall 43 that spans the bowl opening 41 to the bowl bottom 42 and forms the concave interior portion of the bowl. Optionally, receiving bowl 40 may be removable from supported spindle holding device 4 by using a means for removably attaching receiving bowl 40 to the supported spindle holding device 4, which is not depicted. Means for removably attaching receiving bowl 40 to the supported spindle holding device 4 include hook and loop fastening tape, adhesive tape, screws, nails, keel on the receiving bowl 40 and a slot in supported spindle holding device 4, and the like. Also, when a removable receiving bowl is used, it may include means for adjusting the height of the receiving bowl upwards from the top side 410. First attachment end 480 to the supported spindle holding device 4 is also shown. The leg securing means, not depicted, may be run through the attachment end 480 and may be a buckle with loops, snap, hook and loop fastening tape, adhesive tape, or the like to secure the supported spindle holding device to the spinner's thigh.

Figure 5:
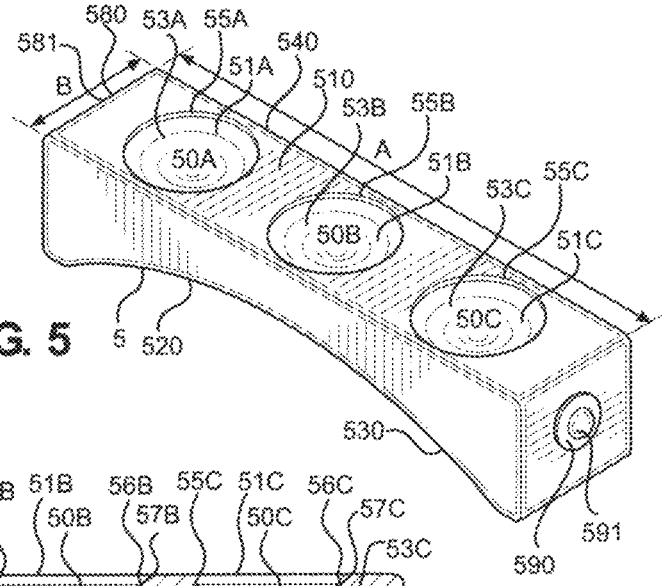
FIG. 5 depicts an overhead view of a supported spindle holding device of the present invention.

FIG. 5 depicts a supported spindle holding device 5 that is an elongated body called a supported spindle holding device 5 of the present invention having a top side 510 opposite a bottom side 520, a body facing side 530 connecting the top side 510 to the bottom side 520, and an away facing side 540 connecting the top side 510 to the bottom side 520. The top side 510 and bottom side 520 each having a length A and width B wherein the length is substantially long enough to cover a spinner's thigh while the spinner is seated and the width being between about 0.5 inch and 8 inches, preferably between about 1 inch and 6 inches, even more preferably between about 2 inches and 5 inches and most preferably between about 3 inches and 4 inches. Disposed on top side 510 substantially in the middle of width B are receiving bowls 50*a*, 50*b*, and 50*c*.

For receiving bowl 50*a*, at the upper portion of the bowl wall 53*a*, but below the bowl opening 51*a* is a lip 55*a*. The lip 55*a* retains the spinning tip of the supported spindle within the confines of the receiving bowl 50*a*. The lip 55*a* preferably runs the entire circumference of the bowl wall 53*a*. The bowl opening 51*a* has a circumference and a diameter. It is preferred that the diameter is between from about 12 inches to about 1/16 inch, more preferable from about 5 inches and to about 1/8 inch, even more preferably from about 3 inches to about 1 inch, and most preferably about 1 5/8 inches.

For receiving bowl 50*b*, at the upper portion of the bowl wall 53*b*, but below the bowl opening 51*b* is a lip 55*b*. The lip 55*b* retains the spinning tip of the supported spindle within the confines of the receiving bowl 50*b*. The lip 55*h* preferably runs the entire circumference of the bowl wall 53*b*. The bowl opening 51*b* has a circumference and a diameter. It is preferred that the diameter is between from about 12 inches to about 1/16 inch, more preferable from about 5 inches and to about 1/8 inch, even more preferably from about 3 inches to about 1 inch, and most preferably about 1 5/8 inches.

For receiving bowl 50*c*, at the upper portion of the bowl wall 53*c*, but below the bowl opening 51*c* is a lip 55*c*. The lip 55*c* retains the spinning tip of the supported spindle within the confines of the receiving bowl 50*c*. The lip 55*c* preferably runs the entire circumference of the bowl wall 53*c*. The bowl opening 51*c* has a circumference and a diameter. It is preferred that the diameter is between from about 12 inches to about 1/16 inch, more preferable from about 5 inches to about 1/8 inch, even more preferably from about 3 inches to about 1 inch, and most preferably about 1 5/8 inches.

The supported spindle holding device 5 is designed to rest on the spinner's thigh when in use. Alternately, the supported spindle holding device may rest on a preferably flat surface. While the supported spindle holding device may rest on the spinners thigh without additional securing aids, it is preferable that a leg securing aid, such as a strap, belt, or rope, be used to further secure the supported spindle holding device on the spinner's leg. Such leg securing aide can be releasably attached to leg securing aid means 581 and 591 that are attached first end 580 and second end 590 that is opposite to the first end 580, respectively. For example, an elongated strap having a length and a width may be used. The length of the elongated strap has two terminal ends. While the supported spindle holding device is resting on a spinner's thigh, one of the terminal ends of the strap is fed through a loop on the leg securing means on the first end 580 then under the spinner's thigh, and then fed through a loop on the leg securing means on the second end 590. The two terminal ends of the strap are then secured to each other. Such securing may be by hook and loop fastening tape, adhesive tape, snaps, buckles and the like.

The distance from top side 510 to bottom side 520 varies from the widest part being at the first end and the second end. Such distance is called the thickness. As depicted in FIG. 5, the thickness tapers from the thickest part at the first end and the second end to the center region being the least thick. This provides the concave shape of the bottom side that is needed to rest the supported spindle holding device on the spinner's thigh.

Figure 5A:
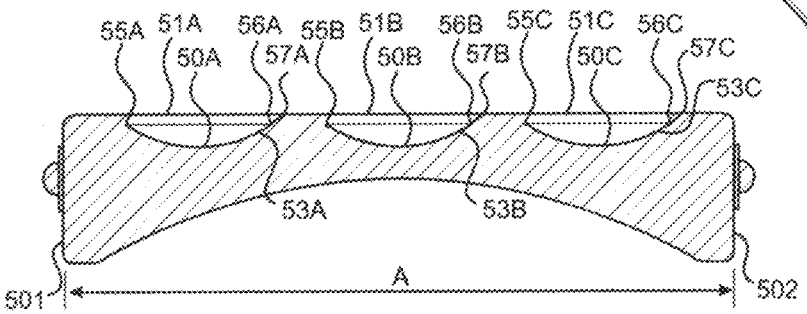
FIG. 5*a* depicts a body facing cross-cut view of a supported spindle holding device of the present invention.

FIG. 5*a* depicts a body facing side view of the supported spindle holding device 5. This view shows integrated receiving bowls 50*a*, 50*b*, and 50*c*, respectively. Receiving bowl 50*a* has an interior bowl opening 51*a* with upper portion of the bowl wall 53*a* containing a lip 55*a*. The lip 55*a* retains the spinning tip of the supported spindle within the confines of the receiving bowl 50*a*. The lip 55*a* preferably runs the entire circumference of the bowl wall 53*a* and contains an upper lip portion 56*a* and a lower lip portion 57*a*, wherein the upper lip portion 56*a* protrudes toward the center of the concave interior portion of the receiving bowl 50*a* and the lower portion extends inwards past the surface of bowl wall 53*a* from about 1/16 of an inch to about 3/4 of an inch, preferably about 1/8 of an inch. Preferably, the lip 55*a* is integral with the bowl wall 53*a*. However, the lip 55*a* may be optionally a detachable ring that fits or snaps into or onto bowl wall 53*a*.

Receiving bowl 50*b* has an interior bowl opening 51*b* with upper portion of the bowl wall 53*b* containing a lip 55*b*. The lip 55*b* retains the spinning tip of the supported spindle within the confines of the receiving bowl 50*b*. The lip 55*b* preferably runs the entire circumference of the bowl wall 53*b* and contains an upper lip portion 56*b* and a lower lip portion 57*b*, wherein the upper lip portion 56*b* protrudes toward the center of the concave interior portion of the receiving bowl 50*b* and the lower portion extends inwards past the surface of bowl wall 53*b* from about 1/16 of an inch to about 3/4 of an inch, preferably about 1/8 of an inch. Preferably, the lip 55*b* is integral with the bowl wall 53*b*. However, the lip 55*b* may be optionally a detachable ring that fits or snaps into or onto bowl wall 53*b*.

Figure 5B:
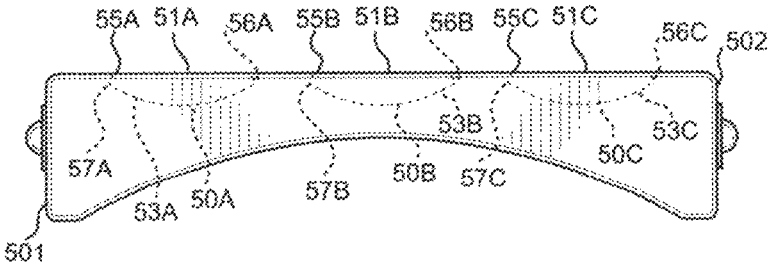
FIG. 5*b* depicts an away facing cross-cut view of a supported spindle holding device of the present invention.

FIG. 5*b* depicts an away facing side view of supported spindle holding device 5. This view shows integrated receiving bowls 50*a*, 50*b*, and 50*c* respectively. Receiving bowl 50*a* has an interior bowl opening 51*a* with upper portion of the bowl wall 53*a* containing a lip 55*a*. The lip 55*a* retains the spinning tip of the supported spindle within the confines of the receiving bowl 50*a*. The lip 55*a* preferably runs the entire circumference of the bowl wall 53*a* and contains an upper lip portion 56*a* and a lower lip portion 57*a*, wherein the upper lip portion 56*a* protrudes toward the center of the concave interior portion of the receiving bowl 50*a* and the lower portion extends inwards past the surface of bowl wall 53*a* from about 1/16 of an inch to about 3/4 of an inch, preferably about 1/8 of an inch. Preferably, the lip 55*a* is integral with the bowl wall 53*a*. However, the lip 55*a* may be optionally a detachable ring that fits or snaps into or onto bowl wall 53*a*.

Receiving bowl 50*b* has an interior bowl opening 51*b* with upper portion of the bowl wall 53*b* containing a lip 55*b*. The lip 55*b* retains the spinning tip of the supported spindle within the confines of the receiving bowl 50*b*. The lip 55*b* preferably runs the entire circumference of the bowl wall 53*b* and contains an upper lip portion 56*b* and a lower lip portion 57*b*, wherein the upper lip portion 56*b* protrudes toward the center of the concave portion of the receiving bowl 50*b* and the lower portion extends inwards past the surface of bowl wall 53*b* from about 1/16 of an inch to about 3/4 of an inch, preferably about 1/8 of an inch. Preferably, the lip 55*b* is integral with the bowl wall 53*b*. However, the lip 55*b* may be optionally a detachable ring that fits or snaps into or onto bowl wall 53*b*.

Receiving bowl 50*c* has an interior bowl opening 51*c* with upper portion of the bowl wall 53*c* containing a lip 55*c*. The lip 55*c* retains the spinning tip of the supported spindle within the confines of the receiving bowl 50*c*. The lip 55*c* preferably runs the entire circumference of the bowl wall 53*c* and contains an upper lip portion 56*c* and a lower lip portion 57*c*, wherein the upper lip portion 56*c* protrudes toward the center of the concave interior portion of the receiving bowl 50*c* and the lower portion extends inwards past the surface of bowl wall 53*c* from about 1/16 of an inch to about 3/4 of an inch, preferably about 1/8 of an inch. Preferably, the lip 55*c* is integral with the bowl wall 53*c*. However, the lip 55*c* may be optionally a detachable ring that fits or snaps into or onto bowl wall 53*c*.

Figure 5C:
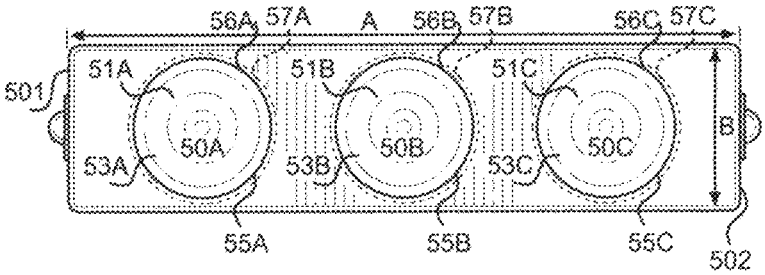
FIG. 5*c* depicts a top view of a supported spindle holding device of the present invention.

FIG. 5*c* depicts a top view of the supported spindle holding device 5. This view shows length A and width B, first end 580 and second end 590. Integrated receiving bowls 50*a*, 50*b*, and 50*c* are depicted with opening 51*a* for receiving bowl 50*a*, opening 51*b* for receiving bowl 50*b*, and opening 51*c* for receiving bowl 50*c*. Also shown are lips 55*a*, 55*b* and 55*c*. The lip 55*a*, 55*b*, and 55*c* retain the spinning tip of the supported spindle within the confines of the receiving bowls 50*a*, 50*b* and 50*c*. The lips 55*a*, 55*b* and 55*c* preferably run the entire circumference of the bowl wall 53*a*, 53*b*, and 53*c* respectively. The bowl openings 51*a*, 51*b*, and 51*c* have a circumference and a diameter. It is preferred that the diameter is between from about 12 inches to about 1/16 inch, more preferable from about 5 inches and to about 1/8 inch, even more preferably from about 3 inches to about 1 inch, and most preferably about 1 5/8 inches. Attachment areas for leg securing means attachments are depicted at first end 501 and second end 502.

Figure 5D:
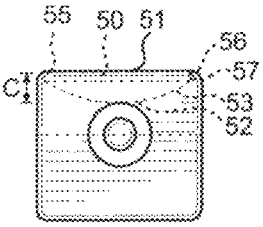
FIG. 5*d* depicts a cross-cut side view of a supported spindle holding device of the present invention.

FIG. 5*d* depicts a side cutout view of the supported spindle holding device 5 containing a receiving bowl 50 as representative of the integrated receiving bowls 50*a*, 50*b*, and 50*c*. At the upper portion of the bowl wall 53, but below the bowl opening 51 is a lip 55. The lip 55 retains the spinning tip of the supported spindle within the confines of the receiving bowl 50. The lip 55 preferably runs the entire circumference of the bowl wall 53 and contains an upper lip portion 56 and a lower lip portion 57, wherein the upper lip portion 56 protrudes toward the center of the concave interior portion of the receiving bowl 50 and the lower portion extends inwards past the surface of bowl wall 53 from about 1/16 of an inch to about 3/4 of an inch, preferably about 1/8 of an inch. Preferably, the lip 55 is integral with the bowl wall 53. However, the lip 55 may be optionally a detachable ring that fits or snaps into or onto bowl wall 53. The receiving bowl 50 has a depth portion C. The length of depth portion C may be of any depth but must be sufficient depth to receive the spinning tip of the supported spindle and maintain the spinning tip using the lip 55 within the receiving bowl 50. Such depth portion C may be from about ¼ to about 2 inches, more preferable from about 5/16 to about 1½ inches, even more preferably from about ½ to about 1 inches. Most preferably about ¾ inches.

Receiving bowl 50 is an integrated substantially bowl or cup that is the concave portion of supported spindle holding device 5, which includes a bowl opening 51, a bowl bottom 52, and a bowl wall 53 that spans the bowl opening 51 to the bowl bottom 52 and forms the concave interior portion of the bowl. Optionally, receiving bowl 50 may be removable from supported spindle holding device 5 by using a means for removably attaching receiving bowl 50 to the supported spindle holding device 5, which is not depicted. Means for removably attaching receiving bowl 50 to the supported spindle holding device 5 include hook and loop fastening tape, adhesive tape, screws, nails, keel on the receiving bowl 50 and a slot in supported spindle holding device 5, and the like. Also, when a removable receiving bowl is used, it may include means for adjusting the height of the receiving bowl upwards from the top side 510. First attachment end 580 to the supported spindle holding device 5 is also shown. The leg securing means, not depicted, may be run through first attachment end 580 and may be a buckle with loops, snap, hook and loop fastening tape, adhesive tape or the like to secure the leg support device to the spinner's thigh.

Figure 6:
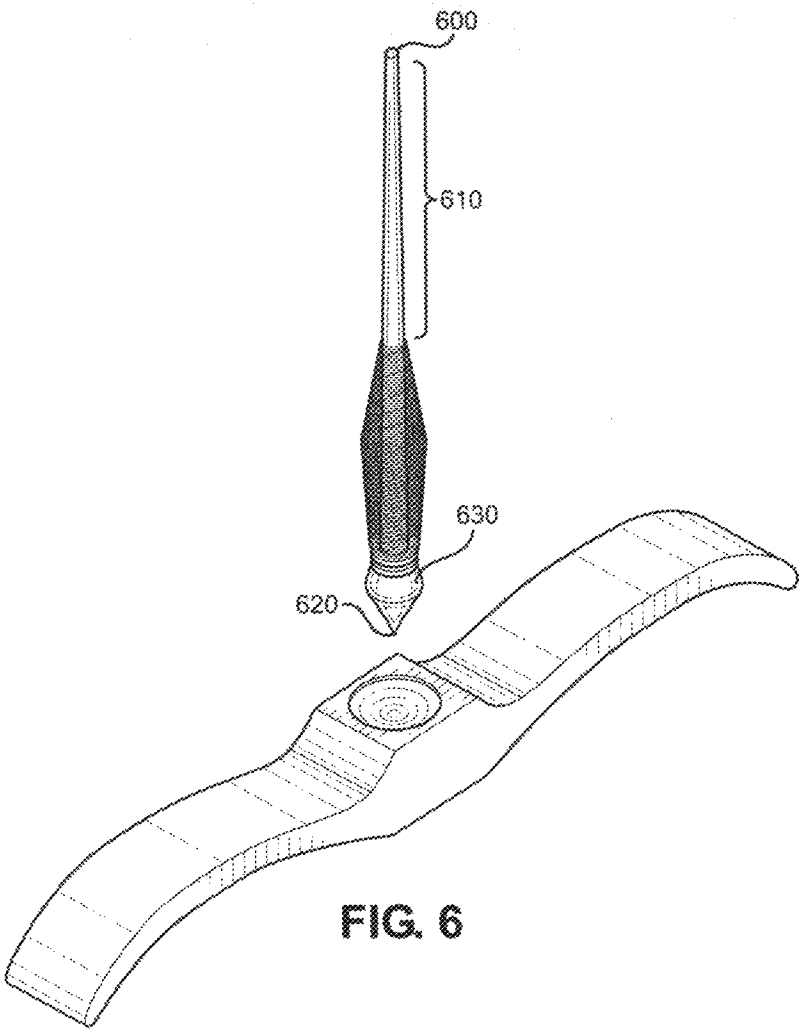
FIG. 6 depicts a supported spindle.

FIG. 6 depicts a support spindle or a supported spindle 6 that includes a flicking tip 600, an elongated shaft 610, and a spinning tip 620 opposite the flicking tip 600. Optionally, the support spindle may include at least one whorl 630, which is a rim or center weighted circular disc attached to the shaft. The type of whorl may be interchanged depending on the fiber to be spun. The spinning tip may be made of any material, including wood, metal and glass.

While the thickness of the supported spindle holding device from the top side to the bottom side is not important, it is important that it is made of materials that provide structural integrity of the supported spindle holding device for conducting supported spindle spinning fiber into yarn or thread. One preferred material is wood. Those skilled in the art of woodworking can manufacture a supported spindle holding device of the present invention from wood being a single solid piece or laminated. The type of wood can vary, but hardwoods such as cherry, maple, and oak are preferred to provide a supported spindle holding device with longevity of use. Other materials include metals, like aluminum, iron, steel, and alloys may be used by those skilled in the art, e.g., a farrier. Polymers may also be used to mold a supported spindle holding device of the present invention. The present invention may be 3-dimensionally printed using polymers and/or metals as well.

The bottom portion of the supported spindle holding device of the present invention may have a textured surface to aid in preventing the supported spindle holding device from moving during use. Such textured surface may be created by any means known in the art, including affixing a textured material to the bottom portion or integrating the textured surface into the bottom portion. Textured materials include any material or polymer that prevents slipping on a surface such as anti-slip tape, contact cement, plastic dip, rubber, and anti-slip paints. Method of integrating the textured surface into the bottom portion include, but are not limited to, applying adhesive on tape, gluing tape on with contact cement or adhesive, brushing on plastic or rubber, or spraying on non-slip material.

What is claimed is:

1. A supported spindle holding device comprising a body having an upper surface having a length and a width and a concave bottom surface having a length and a width for resting the bottom surface of the supported spindle holding device on a thigh of a spinner and a receiving bowl integrated in the upper surface of the body for receiving a spinning tip of the supported spindle, the receiving bowl having a bowl opening, a bowl bottom opposite the bowl opening, a bowl wall that spans from the bowl opening to the bowl bottom to form a concave interior portion of the bowl, and a lip that (a) is integral with the bowl wall, (b) is located between the bowl opening and the bowl bottom, (c) coextensively spans the circumference of the bowl wall, and (d) is parallel to the bowl opening, wherein the lip includes an upper lip portion and an opposite lower lip portion that join at a junction, wherein the upper lip portion extends outward away from a center of the bowl into the body to the junction such that the junction has a larger circumference than the bowl opening, where in the lower lip portion is parallel to the upper lip portion and extends from the junction inward toward the center of the bowl, and the upper lip portion is closer to the bowl opening than the lower lip portion.

2. The supported spindle holding device of claim 1, wherein the bottom surface comprises a textured surface.

* * * * *